United States Patent [19]

Nielsen

[11] 4,172,334

[45] Oct. 30, 1979

[54] DISPLAY AND STOCKING STANDS

[76] Inventor: Eigil K. Nielsen, 3-5 Lundavägen, Huddinge, Sweden S-141 22

[21] Appl. No.: 839,447

[22] Filed: Oct. 5, 1977

[51] Int. Cl.[2] ..... G09F 15/00

[52] U.S. Cl. ..... 40/607

[58] Field of Search ..... 40/607, 606, 617, 152.1

[56] References Cited

U.S. PATENT DOCUMENTS

| | | | |
|---|---|---|---|
| 288,628 | 11/1883 | Enos | 40/607 |
| 829,064 | 8/1906 | Elder et al. | 40/607 |
| 1,661,948 | 3/1928 | Innes | 40/606 |
| 3,676,942 | 7/1972 | Elrod | 40/124.2 |

FOREIGN PATENT DOCUMENTS

| | | | |
|---|---|---|---|
| 1561580 | 9/1967 | Fed. Rep. of Germany | 40/607 |

*Primary Examiner*—Louis G. Mancene
*Assistant Examiner*—Wenceslao J. Contreras
*Attorney, Agent, or Firm*—Schuyler, Birch, McKie & Beckett

[57] ABSTRACT

A display stand comprising rod-like standards having sleeves secured thereto at spaced intervals. The sleeves have another cross-section shape than the rods whereby open spaces are defined therebetween. Hook-like coupling members belonging to components to be carried by the standards connect the said components to the standards by engaging selected ones of said open spaces.

9 Claims, 6 Drawing Figures

FIG.4
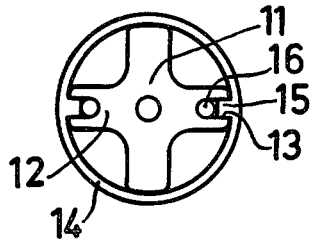
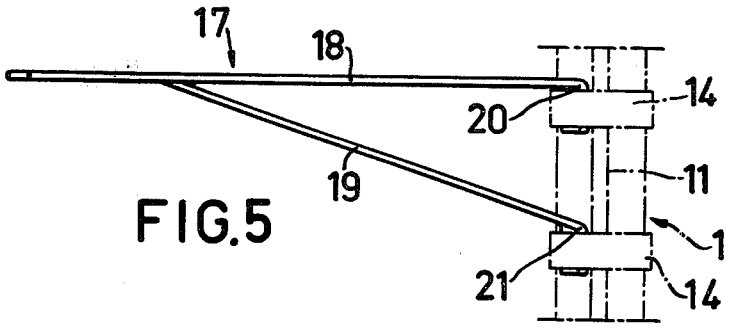
FIG.5
FIG.6
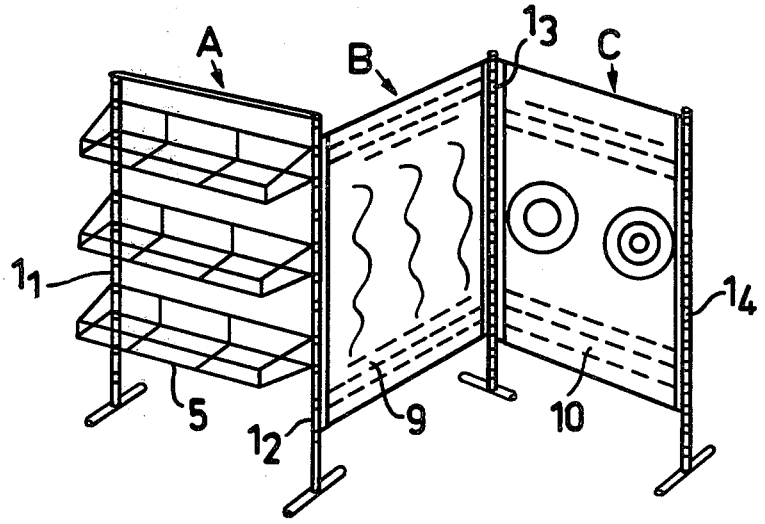

DISPLAY AND STOCKING STANDS

This invention relates to a stand for displaying and stockage of goods, for holding folders, brochures or leaflets, for mounting placards and posters etc., which comprises standards identically alike which can be connected by strut members, baskets, trays, shelves or the like which may be mounted in desired positions on said standards by means of coupling members.

It has been proposed to construct stands of the character described using standards joined together of a plurality of tubular elements and coupling members. Such standards have to be assembled before use, and this will require that they are manufactured to rather close tolerances to render the erected structures reasonably stable. In some cases the user may have some difficutly in finding the correct manner of assembling the parts. It is an object of the invention, therefore, to provide a standard forming an integral unit and allowing of a great number of variations of the stand structures erected with use of these standards and of trays, shelves, baskets, etc. for stockage and displaying of goods, brochures, leaflets, posters and the like.

The invention will now be described in greater detail, reference being had to the drawings which illustrate some preferred embodiments.

In the drawings

FIG. 4 is a similar cross-section view of a standard according to a further embodiment;

FIG. 5 is an elevation view of a bracket member;

FIG. 6 is a perspective view of a combined stand.

Figure 1:
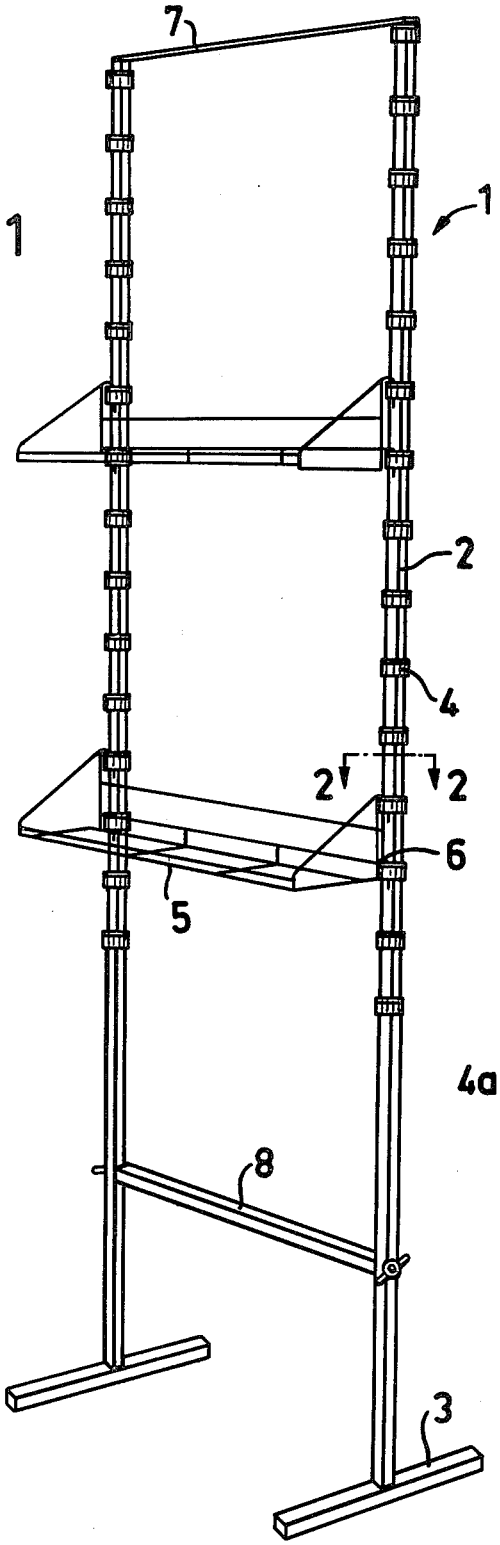
FIG. 1 is a perspective view showing a stand in a basic form and comprising two standards and two trays.

The stand illustrated in FIG. 1 is assembled of two identical standards 1 which are formed of a tube 2 having square cross section, a transverse member 3 being attached to one end of the tube to serve as a base.

Figure 2:
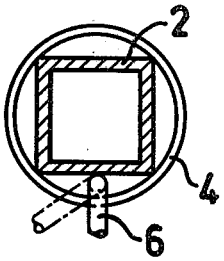
FIG. 2 is a cross-section view along line 2—2 in FIG. 1 on a larger scale.

Short tubular members or sleeves 4 are attached at spaced intervals to at least an upper portion of the tube 2 and surround the tube engaging the corners thereof being secured as by welding or brazing or by any other suitable means (FIG. 2). The spacing of sleeve members 4 is preferably equal, to match the dimensions and spacing of wire baskets or wire trays 5 connecting two standards 1 and carried by the latter. The wire structures 5 are formed with hook members 6 (FIG. 2) for engaging into the spaces between the tubes 2 and sleeve members 4. FIG. 2 also illustrates that the hook members 6 can engage the sleeves 4 obliquely (chain lines), and this facilitates the erecting of multi-standard stands having a staggered or broken disposition. The provision of four separate spaces between the tube 2 and the sleeve members 4 greatly enhances the possibility of building stands of an angular configuration and in different combinations.

Figure 3:
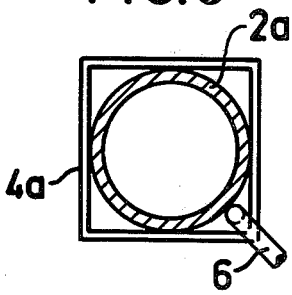
FIG. 3 is a similar cross-section view of a standard according to an alternative embodiment.

The standards may alternatively be made of circular tubes 2*a*, the sleeve members 4*a* having square cross section as seen from FIG. 3. By this arrangement four separate spaces between the tube 2*a* and each sleeve member 4*a* will also be defined.

The wire structures 5 or other components carried by the standards 1 may render the assembled stands sufficiently stable, but the rigidity will be increased by providing detachable transverse structs 7, 8 between the standards, as illustrated in FIG. 1. These struts may be joined to the standards by threaded connections.

FIGS. 2 and 3 show standards manufactured of commercially available tubing of circular and square cross section. FIG. 4 is a cross-section view of a standard formed of a profile member and circular sleeves having a mating interior shape.

The standard shown in FIG. 4 comprises a structural rod member 11 having a substantially cruciform cross section and formed of extruded aluminium or aluminium alloy. A longitudinal groove 13 is formed in the end face of two diametrally opposed cross arms 12. Cylindrical sleeve members 14 are slid over the roll 11 and are guided by two diametrally opposed axially extending ridges or ribs 15 formed at the inside of the sleeves 14 and engaging the grooves 13 but leaving free a space between the top of the ridges and the bottom of the grooves. The radial dimension of the ridges is such that a slender circular rod 16 of steel lodged in the bottom of the groove will engage the top of the sleeve ridges and will expand the sleeves somewhat along a diameter thereby making them all engage the two non-grooved cross arms tightly. The sleeves 14 accordingly will become firmly and rigidly attached to the rod 11. The spaces defined between the cross arms and the sleeves will receive hook members 6 belonging to baskets, trays, shelves or other components supported by the standards and forming with these a rigid stand.

FIG. 5 illustrates a bracket suitable for mounting shelves and the like. This bracket 17 is formed of two rigid metal strips, a longer strip 18 and a shorter strip 19 welded together at a point some distance from one end of the longer strip 18. The strips diverge towards their opposite ends and those ends are bent hook-like downwards as at 20 and 21 are spaced corresponding to the spacing between two sleeve members 14 on the rods 11. When the hook portions 20, 21 are engaged in aligned spaces along the rod 11 the bracket will form a support for a shelf or the like which may be held in its position by having studs at its underside passing through corresponding holes in the upper bracket strip 18.

In FIG. 6 there is shown how a combined stand can be constructed. The stand section A to the left is like the one illustrated in FIG. 1 and comprises standards $1_1$ and $1_2$ with wire trays 5. To this section A there are connected two further sections B and C. Section B is connected to the standard $1_2$ belonging to section A by being coupled by hook members, not illustrated but similar to hook members 6, to this standard, whereas its other side is coupled to a standard $1_3$, the latter in its turn serving as a support of the section C carried at its other side by a further standard $1_4$.

As illustrated the different sections form an angle to each other, and it should be appreciated that the shape and nature of the elements forming the structure afford great possibilities of varying these angles.

The sections B and C are different from the section A by comprising, instead of wire structures, flat or curved holders 9, 10 for posters, photographs or the like. These holders are preferably formed of double transparent flat or curved sheets of plastic joined together along their lateral edges by metal profiles having hook members like those belonging to the wire structures for coupling to the standards. The plastic sheets will accomodate between them the posters or other flat objects to be shown or exhibited.

It is easily appreciated from the foregoing that the invention provides means of constructing stands having a practically unlimited number of supporting standards and wire structures or other components connecting the standards and extending in different horizontal directions. This makes for easy adjustment to different requirements and localities without the need for any extensive planning or assembling work. It is also, of course, possible to build stands in which the components carried by the standards radiate in more directions than two, for instance three or four.

What I claim is:

1. A stand for displaying and stocking goods, brochures, posters and the like comprising spaced standards and components for coupling together such standards to be carried thereby and to form a rigid, self-supporting stand, said standards being made to full constructional length and spaced sleeve members encircle the circumference of said standards, said sleeve members having an internal cross-section shape differing from the outer cross-section shape of said standards, said standards and said sleeve members having common areas of contact, said areas of contact separating interspaces therebetween, said interspaces being capable of accommodating hook-shaped coupling members provided on said components such as baskets, trays, shelves, transparent poster and placard pockets.

2. A stand according to claim 1 wherein transverse base members are provided at the bottom of each standard.

3. A stand according to claim 1 wherein the standards comprise tubes having square cross section and the sleeves are annulus-shaped tube sections secured to the corners of the tube.

4. A stand according to claim 1 wherein the standards comprise tubes having circular cross section and the sleeves are square-shaped tube sections secured between the ends of their sides to said tubes.

5. A stand according to claim 1 wherein the standards comprise profile rods having a cruciform cross section and the sleeves are circular-shaped.

6. A stand according to claim 5 wherein said profile rod is formed with a longitudinal groove along at least one of said cross arms, said sleeves being formed with corresponding ridge means for engagement with said at least one groove, circular rod means being located at the bottom of said at least one groove for engaging said ridge means.

7. A stand according to claim 1 wherein components formed with hook-shaped portions engage the circumference of selected sleeve members of at least two standards.

8. A stand according to claim 7 wherein said components comprise wire structures.

9. A stand according to claim 1 wherein said hook-shaped coupling members are formed of angularly-bent wire portions.

* * * * *